US011795798B2

(12) United States Patent
Williams

(10) Patent No.: US 11,795,798 B2
(45) Date of Patent: Oct. 24, 2023

(54) PUMPING SYSTEM FOR A WELLSITE

(71) Applicant: ShalePumps, LLC, Houston, TX (US)

(72) Inventor: Jason C. Williams, Magnolia, TX (US)

(73) Assignee: SHALEPUMPS, LLC, Houston, TX (US)

( * ) Notice: Subject to any disclaimer, the term of this patent is extended or adjusted under 35 U.S.C. 154(b) by 216 days.

(21) Appl. No.: 16/843,760

(22) Filed: Apr. 8, 2020

(65) Prior Publication Data

US 2020/0325761 A1 Oct. 15, 2020

Related U.S. Application Data

(60) Provisional application No. 62/831,363, filed on Apr. 9, 2019.

(51) Int. Cl.

| | |
|---|---|
| ***E21B 43/26*** | (2006.01) |
| ***F04B 1/00*** | (2020.01) |
| ***F04B 53/18*** | (2006.01) |
| ***F04B 17/05*** | (2006.01) |
| ***F04B 15/02*** | (2006.01) |

(52) U.S. Cl.

CPC ..... *E21B 43/2607* (2020.05); *F04B 1/00* (2013.01); *F04B 15/02* (2013.01); *F04B 17/05* (2013.01); *F04B 53/18* (2013.01)

(58) Field of Classification Search

CPC ..... E21B 43/2607; E21B 43/26; F04B 1/00; F04B 1/053; F04B 1/0538; F04B 15/02; F04B 17/05; F04B 17/06; F04B 23/06; F04B 53/18

See application file for complete search history.

(56) References Cited

U.S. PATENT DOCUMENTS

| | | | | |
|---|---|---|---|---|
| 2016/0177945 | A1* | 6/2016 | Byrne | F04B 53/18 184/6 |
| 2017/0234308 | A1* | 8/2017 | Buckley | E21B 43/26 417/53 |
| 2018/0363640 | A1* | 12/2018 | Kajita | G05B 19/042 |
| 2019/0154020 | A1* | 5/2019 | Glass | F04B 17/03 |
| 2019/0178235 | A1* | 6/2019 | Coskrey | F04B 47/02 |
| 2020/0040878 | A1* | 2/2020 | Morris | E21B 43/26 |

FOREIGN PATENT DOCUMENTS

| | | | | |
|---|---|---|---|---|
| WO | WO-2015007501 | A1 * | 1/2015 | F02C 7/222 |
| WO | WO-2020131085 | A1 * | 6/2020 | F04B 49/06 |

* cited by examiner

*Primary Examiner* — James G Sayre

(74) *Attorney, Agent, or Firm* — Chamberlain, Hrdlicka, White, Williams, & Aughtry

(57) ABSTRACT

A pumping system is provided. The pumping system may include a drive assembly and a pump assembly that is operatively coupled to the drive assembly. The pump assembly may include a pump configured to pressurize a fluid and a multispeed gearbox that is attached to the pump. The multispeed gearbox may be configured to transfer rotational energy from the drive assembly to the pump.

19 Claims, 4 Drawing Sheets

PUMPING SYSTEM FOR A WELLSITE

BACKGROUND

The production of hydrocarbons from a subterranean formation may include fracturing of the subterranean formation by injecting fluids at a high pressure through a wellbore. The injected fluids may create or expand fractures in the subterranean formation, allowing for increased production of hydrocarbons. Such fracturing involves the use of one or more high pressure pumping systems to generate the high-pressure fluid. Typical pumping systems that are used to generate the high-pressure fluid include diesel engines. However, diesel engines consume large amounts of fuel that must be transported to the wellsite, adding a significant cost to the fracturing operations.

SUMMARY

Certain embodiments of the disclosed invention may include a pumping system. The pumping system may include a drive assembly and a pump assembly that is operatively coupled to the drive assembly. The pump assembly may include a pump configured to pressurize a fluid and a multispeed gearbox that is attached to the pump. The multispeed gearbox may be configured to transfer rotational energy from the drive assembly to the pump.

Certain embodiments of the disclosed invention may include a system for pumping fluid into a wellbore. The system may include a wellhead and a pumping system fluidly coupled to the wellhead and configured to flow fluid into the wellbore. The pumping system may include a drive assembly and a pump assembly that is operatively coupled to the drive assembly. The pump assembly may include a pump configured to pressurize a fluid and a multispeed gearbox that is attached to the pump. The multispeed gearbox may be configured to transfer rotational energy from the drive assembly to the pump.

Certain embodiments of the disclosed invention may include a method of fracturing a formation. The method may include operating a drive assembly to produce rotational energy. The method may further include transferring the rotational energy produced by the drive assembly to a pump through a prime mover gearbox attached to a prime mover of the drive assembly and a multispeed gearbox attached to the pump. The method may also include pressurizing a fracturing fluid using the pump. The method may further include injecting the pressurized fluid into the formation through a wellhead to fracture the formation.

Other aspects of the invention will be apparent from the following description and the appended claims.

BRIEF DESCRIPTION OF DRAWINGS

Embodiments of the pumping system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Specific embodiments of the invention will now be described in detail with reference to the accompanying figures. In the following detailed description of the embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In the following description of FIGS. 1-4, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment, which may be implemented in addition to, in conjunction with, or in place of the embodiments described with regard to a corresponding like-named component in any other figure.

Throughout the application, ordinal numbers (e.g., first, second, third, etc.) may be used as an adjective for an element (i.e., any noun in the application). The use of ordinal numbers is not to necessarily imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

The present disclosure provides a pumping system for a wellsite. The pumping system supplies high pressure fluid for use in, e.g., fracturing a subterranean formation surrounding the wellbore. The pumping system may also be used for other wellsite operations.

Figure 1:
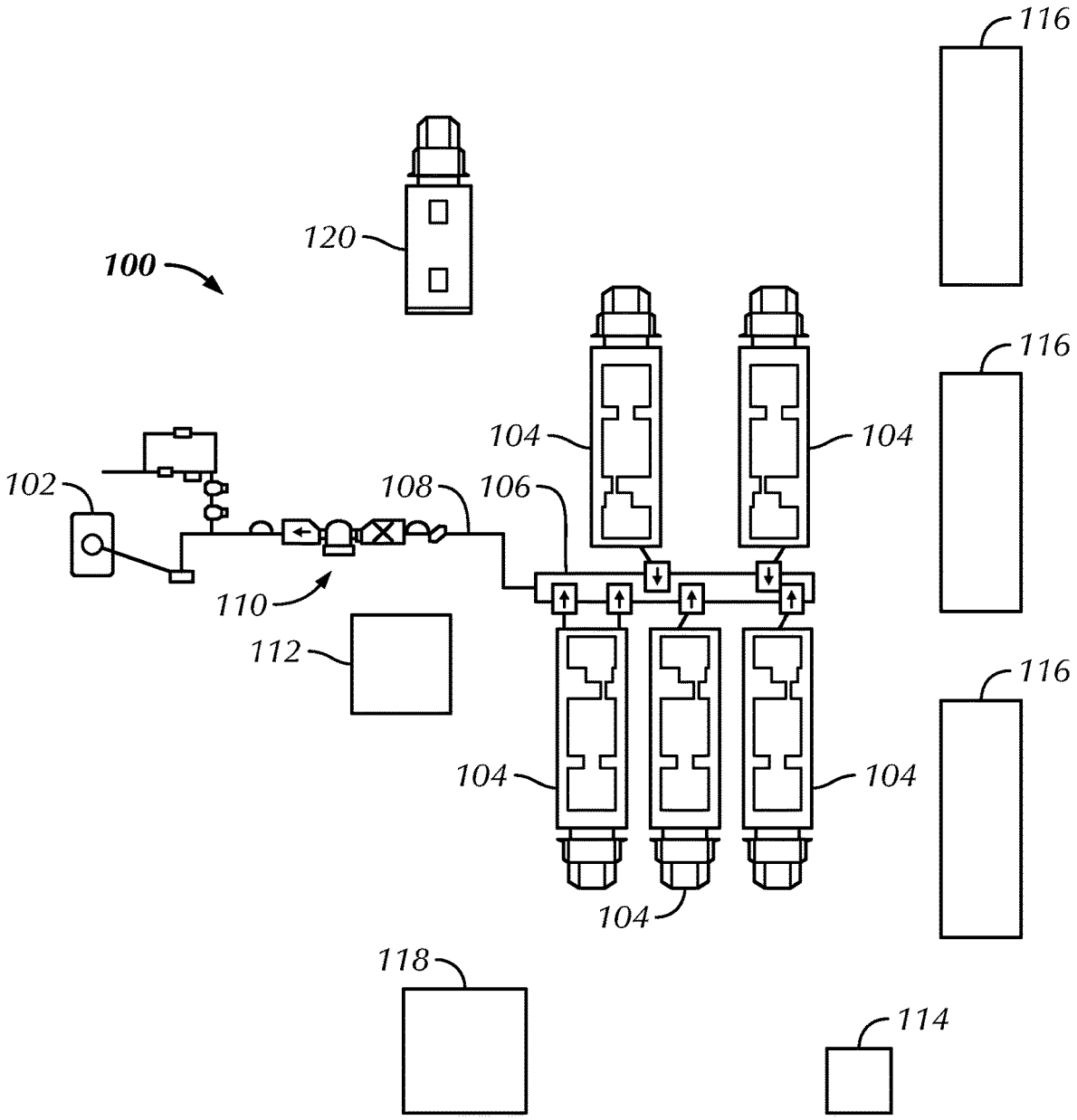
FIG. 1 is a schematic view of a wellsite according to one or more embodiments.

FIG. 1 is a schematic diagram of a wellsite 100, according to one or more embodiments. Turning to FIG. 1, the wellsite includes a wellhead 102 positioned over a wellbore (not shown) and connected to one or more pieces of wellsite equipment, such as, pumping systems 104. The pumping systems 104 are connected to a manifold 106 and piping 108. Further, the piping 108 may include additional equipment, such as, valves 110 and flowmeters (not shown). This additional equipment may be used, e.g., to monitor and/or control the flow of fluid into a wellbore through the wellhead 102.

The wellsite 100 may also include other pieces of equipment, such as, a generator 112, a blender 114, storage tanks 116 (three shown), a fluid distribution system 118, and a monitoring and control unit 120. Each of these additional pieces of equipment is described below.

The storage tanks 116 may contain fuel, wellbore fluids, proppants, diesel exhaust fluid, and/or other fluids. The fluid distribution system 118 is fluidly coupled to one or more pieces of wellsite equipment, such as, the pumping systems 104, the generator 112, the blender 114, or the monitoring and control unit 120. The fluid distribution system 118 may supply fluids, such as, fuel, diesel exhaust fluid, fracturing fluid, and/or other fluids, to the pieces of wellsite equipment 104, 112, 114 from one or more of the storage tanks 116. In one or more embodiments, all or a portion of the aforementioned wellsite equipment may be mounted on trailers. However, the wellsite equipment may also be free standing or mounted on a skid.

This disclosure is not limited to the wellsite shown in FIG. 1.

Figure 2:
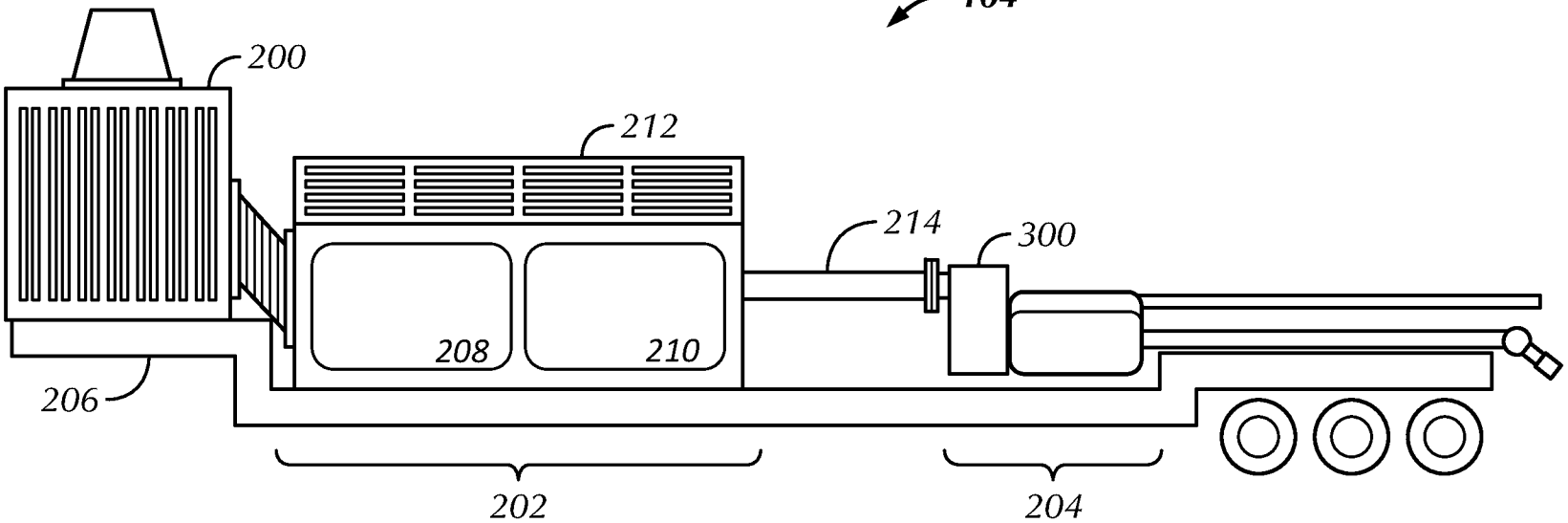
FIG. 2 is a schematic diagram of the pumping system of FIG. 1 according to one or more embodiments.

FIG. 2 is a schematic diagram of a pumping system 104 of FIG. 1 in accordance with one or more embodiments. The pumping system 104 includes an exhaust 200, a drive assembly 202, and a pump assembly 204 on a trailer 206. Each of these components is described below.

In one or more embodiments, the exhaust 200 is fluidly coupled to the drive assembly 202 and removes exhaust gases that are produced during the operation of the drive assembly 202. The trailer 206 may also include one or more secondary systems, e.g., an electric generator (not shown), a steam generation system (not shown), and a hydraulics system (not shown).

Continuing with the discussion of FIG. 2, in one or more embodiments, the drive assembly 202 includes a prime mover 208 and a prime mover gearbox 210 positioned within a drive assembly housing 212. In various embodiments, the drive assembly 202 may utilize natural gas from the well as a fuel source.

In other embodiments, the drive assembly 202 may include a prime mover and a prime mover gearbox that are not disposed within a common housing (e.g., 212), the prime mover gearbox may be omitted, or a prime mover that utilizes a different fuel source. In at least one embodiment, the prime mover is a twin shaft turbine engine. In other embodiments, the prime mover may be a single shaft turbine engine, an internal combustion engine, or an electric motor. The prime mover is not limited to the aforementioned examples. The prime mover may produce power within a range of 1,000 horsepower to 20,000 horsepower; however other embodiments of the pumping system may utilize a prime mover(s) that produces less than 1,000 horsepower or more than 20,000 horsepower.

Continuing with the discussion of the drive assembly 202, the prime mover is connected to a prime mover gearbox, either directly or through a driveshaft (not shown) extending between the prime mover and the prime mover gearbox. The prime mover gearbox is also connected to the pump assembly 204 through a driveshaft 214 that transfers rotational energy produced by the drive assembly 202 to the pump assembly 204. However, in at least one embodiment, the prime mover gearbox may be directly connected to the pump assembly 204 instead of connected through a driveshaft 214. In another embodiment, the prime mover gearbox may be omitted and the prime mover may be directly connected to the pump assembly 204 or connected to the pump assembly 204 through a driveshaft 214. Additional detail about the operation of the pump assembly 204 is provided in FIG. 3.

Continuing with the discussion of FIG. 2, in one or more embodiments, the prime mover gearbox is a single-speed gearbox that reduces the rotational speed and increases the torque output from the drive assembly 202. The magnitude of the reduction in rotational speed and the magnitude of the increase in torque output are based on a single-gear ratio determined by gears contained within the prime mover gearbox. In other embodiments, the prime mover gearbox is a multispeed gearbox that can be shifted between one of two or more gear ratios to adjust the rotational speed and torque output from the drive assembly 202. In both instances, the prime mover and prime mover gearbox typically share a common lubricating oil reservoir of specialty oil that has a much lower oil weight than what is typically utilized in a gearbox. Therefore, the gears within the prime mover gearbox must be manufactured with precise tolerances so that they will not be damaged during operation of the drive assembly 202. Accordingly, a multispeed gearbox may significantly increase the cost of the drive assembly 202 when compared to a single-speed prime mover gearbox, as the precise tolerances must be maintained on more components within the prime mover gearbox.

Figure 3:
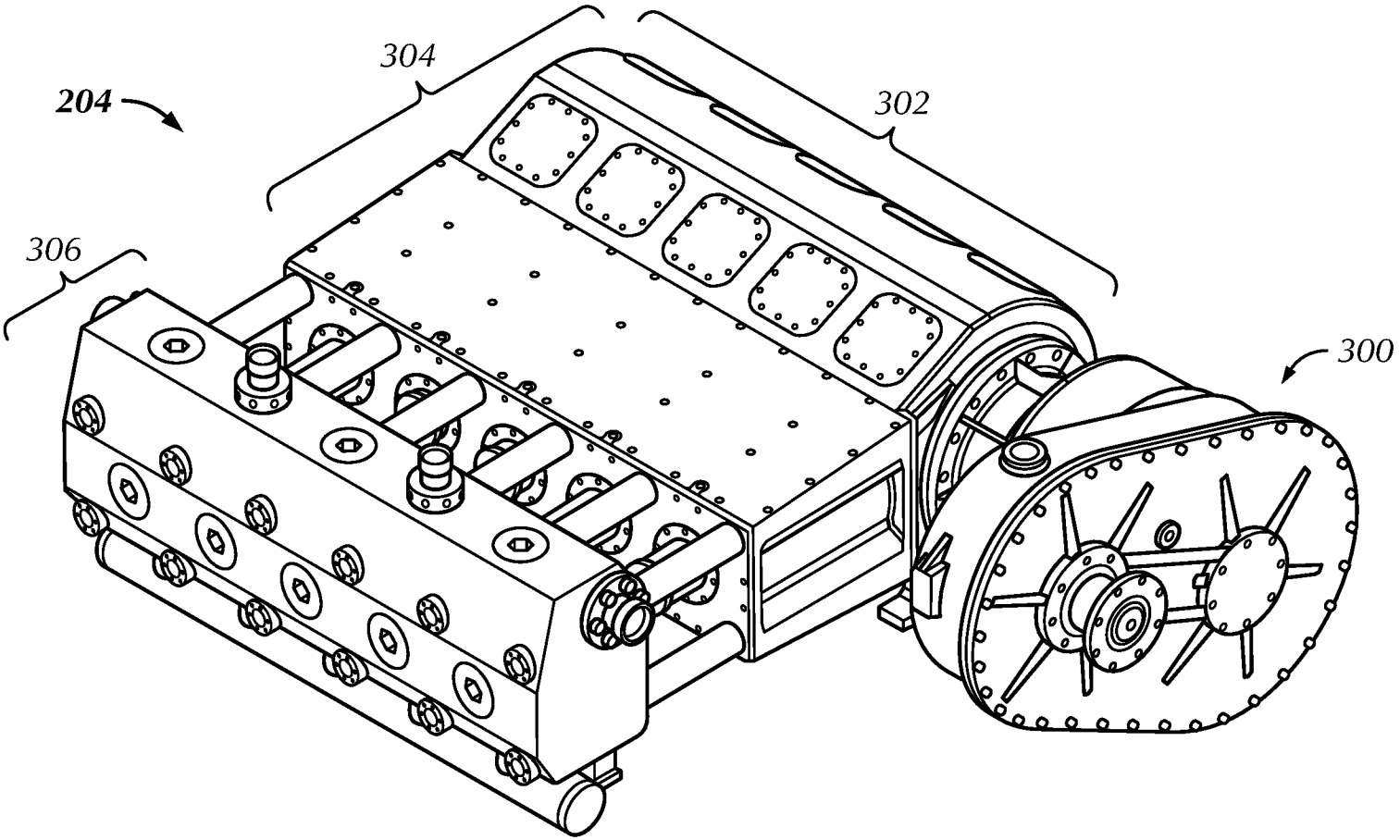
FIG. 3 is an isometric view of the pump assembly of FIG. 2 according to one or more embodiments.

Referring now to FIG. 3, FIG. 3 is an isometric view of the pump assembly 204 shown in FIG. 2 in accordance with one or more embodiments. The pump assembly 204 includes a multispeed gearbox 300 that is connected to a pump 302. The multispeed gearbox 300 and the pump assembly 204 share a common lubricating oil reservoir (not shown) with the pump 302. The multispeed gearbox 300 is attached to the driveshaft 214, as shown in FIG. 2, and to the power end 304 of the pump 302 to transfer rotational energy produced by the drive assembly 202 to the pump 302.

In one or more embodiments, the multispeed gearbox 300 can be manually shifted between any one of two or more gear ratios by an operator to adjust the rotational speed and torque transferred from the driveshaft 214 to the pump 302 through the multispeed gearbox 300. The multispeed gearbox 300 allows the system to vary the rotational speed and torque transferred to the pump 302 when utilizing a single speed prime mover gearbox, thereby minimizing the total cost of the pumping system 104 while maintaining adjustability in the pumping system 104.

In another embodiment, the multispeed gearbox 300 may be an automatic gearbox capable of shifting between gear ratios based on the input of a control system (not shown) instead of a manual operation by an operator.

Continuing with the discussion of FIG. 3, in one or more embodiments, the pump 302 is a reciprocating positive displacement pump that includes a crankshaft (not shown) within the power end 304 and multiple pistons (not shown) or plungers (not shown) that are disposed within cylinders (not shown) in a fluid end 306 of the pump assembly 204. The rotational energy transferred from the driveshaft 214 (not shown in FIG. 3) through the multispeed gearbox 300 rotates the crankshaft within the power end 304 to reciprocate the pistons or plungers within the respective cylinders. The reciprocation of the pistons, or plungers, moves fluid from one or more of the storage tanks 116 through the pump 302 in a manner that pressurized the fluid. The pressurized fluid is then output from the pump 302 and then, e.g., injected through the wellhead 102 to fracture a subterranean formation.

Figure 4:
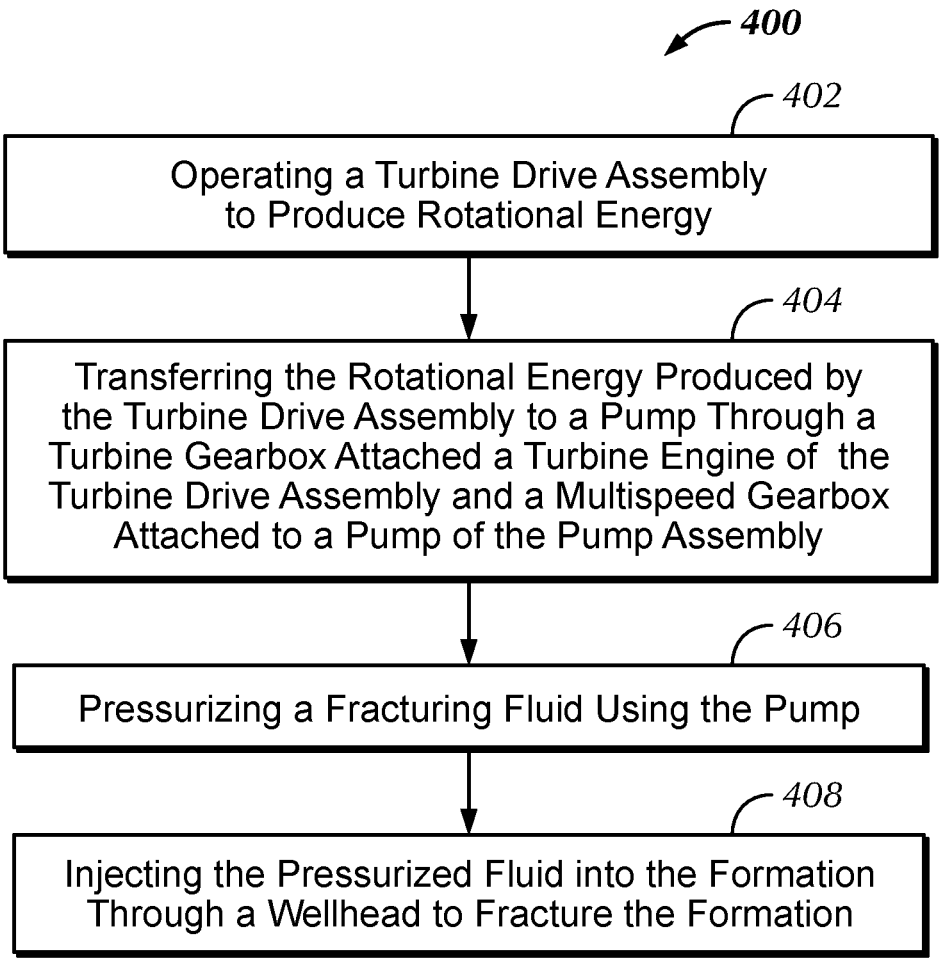
FIG. 4 is a flow chart illustrating a method of operating a pumping system, according to one or more embodiments.

FIG. 4 is a flow chart 400 illustrating a method of fracturing a formation. The drive assembly 202 is operated to produce rotational energy, as shown at 402. The rotational energy produced by the drive assembly 202 is then transferred to the pump assembly 204 through a prime mover gearbox attached a prime mover of the drive assembly 202 and a multispeed gearbox 300 attached to a pump 302 of the pump assembly 204, as shown at 404. The pump 302 pressurizes a fracturing fluid, as shown at 406. The pressurized fracturing fluid is then injected into the formation through a wellhead 102 to fracture the formation, as shown at 408.

Although the pumping system 104 is described with reference to a fracturing operation, the pumping system 104 is not thereby limited. The pumping system 104 could also be used for cementing operations, chemical injection operations, or any other type of well operation that requires the use of a pumping system 104.

One or more specific embodiments of the pumping system for a wellsite have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pumping system comprising:

a drive assembly comprising a prime mover comprising either a turbine engine or an electric motor;

a driveshaft coupled to the drive assembly and configured to transfer rotational energy from the drive assembly; and a pump assembly operatively coupled to the drive assembly, wherein the pump assembly comprises:

a pump configured to pressurize a fluid, and a multispeed gearbox integrated into the pump and coupled to the driveshaft to receive rotational energy from the drive assembly via the driveshaft and transfer the rotational energy to the pump.

2. The pumping system of claim 1, wherein the pump is a positive displacement pump.

3. The pumping system of claim 2, wherein the positive displacement pump is a piston reciprocating pump or a plunger reciprocating pump.

4. The pumping system of claim 1, wherein the drive assembly comprises a prime mover coupled to a prime mover gearbox; and wherein the prime mover gearbox is operatively coupled to the multispeed gearbox.

5. The pumping system of claim 4, wherein the prime mover is a twin shaft turbine engine.

6. The pumping system of claim 1, wherein the drive assembly comprises a prime mover operatively coupled to the multispeed gearbox.

7. The pumping system of claim 4, wherein the drive assembly further comprises a drive assembly oil reservoir that supplies lubricating oil to the prime mover and the prime mover gearbox.

8. The pumping system of claim 1, wherein the drive assembly produces power within a range of 4,000 to 20,000 horsepower.

9. The pumping system of claim 1, wherein the pump assembly further comprises a pump oil reservoir that supplies lubricating oil to the pump and the multispeed gearbox.

10. A system for pumping fluid into a wellbore, the system comprising:

a wellhead; and a pumping system fluidly coupled to the wellhead and configured to flow fluid into the wellbore, wherein the pumping system comprises:

a drive assembly comprising a prime mover comprising either a turbine engine or an electric motor;

a driveshaft coupled to the drive assembly and configured to transfer rotational energy from the drive assembly, and a pump assembly operatively coupled to the drive assembly, the pump assembly comprising:

a pump configured to pressurize the fluid, and a multispeed gearbox integrated into the pump and coupled to the driveshaft to receive rotational energy from the drive assembly via the driveshaft and transfer the rotational energy to the pump.

11. The system of claim 10, wherein the pump is a positive displacement pump.

12. The system of claim 11, wherein the positive displacement pump is a piston reciprocating pump or a plunger reciprocating pump.

13. The system of claim 10, wherein the drive assembly comprises a prime mover coupled to a prime mover gearbox.

14. The system of claim 13, wherein the prime mover is a twin shaft turbine engine.

15. The system of claim 13, wherein the drive assembly further comprises a drive assembly reservoir that supplies lubricating oil to the prime mover and the prime mover gearbox; and wherein the prime mover gearbox is operatively coupled to the multispeed gearbox.

16. The system of claim 10, wherein the drive assembly comprises a prime mover operatively coupled to the multispeed gearbox.

17. The system of claim 10, wherein the drive assembly produces power within a range of 4,000 to 20,000 horsepower.

18. The system of claim 10, wherein the pump assembly further comprises a pump oil reservoir that supplies lubricating oil to the pump and the multispeed gearbox.

19. The system of claim 10, wherein the pump assembly is operatively coupled to the drive assembly using a driveshaft.

* * * * *